US010189690B2

(12) United States Patent
Fiorese et al.

(10) Patent No.: US 10,189,690 B2
(45) Date of Patent: Jan. 29, 2019

(54) VEHICLE LIFT

(71) Applicants: Marta Fiorese, Albignasego (IT); Sara Fiorese, Albignasego (IT)

(72) Inventors: Marta Fiorese, Albignasego (IT); Sara Fiorese, Albignasego (IT); Francesco Fiorese, Albignasego (IT)

(73) Assignees: Marta Fiorese, Albignasego (PD) (IT); Sara Fiorese, Albignasego (PD) (IT)

( * ) Notice: Subject to any disclaimer, the term of this patent is extended or adjusted under 35 U.S.C. 154(b) by 49 days.

(21) Appl. No.: 15/311,936

(22) PCT Filed: May 20, 2015

(86) PCT No.: PCT/EP2015/061154
§ 371 (c)(1),
(2) Date: Nov. 17, 2016

(87) PCT Pub. No.: WO2015/177233
PCT Pub. Date: Nov. 26, 2015

(65) Prior Publication Data

US 2017/0088404 A1 Mar. 30, 2017

(30) Foreign Application Priority Data

May 22, 2014 (IT) ..... VI2014A0135

(51) Int. Cl.
*B66F 3/24* (2006.01)
*B66F 7/08* (2006.01)
*B66F 7/06* (2006.01)

(52) U.S. Cl.
CPC ..... *B66F 7/08* (2013.01); *B66F 7/065* (2013.01)

(58) Field of Classification Search
USPC ..... 254/89 H, 93 R, 122, 290
See application file for complete search history.

(56) References Cited

U.S. PATENT DOCUMENTS 8,469,152 B2 * 6/2013 Olsen ..... B66F 7/065 187/211
9,290,365 B2 * 3/2016 Polins ..... B66B 9/16
2006/0151252 A1 * 7/2006 Joos ..... B66B 9/04 187/269

FOREIGN PATENT DOCUMENTS

DE 8705232 U1 6/1987
EP 0936177 A1 8/1999
(Continued)

OTHER PUBLICATIONS

Written Opinion of the International Searching Authority, dated Jun. 30, 2015.
International Search Report, dated Jun. 30, 2015.

*Primary Examiner* — Joseph J Hail
*Assistant Examiner* — Shantese McDonald
(74) *Attorney, Agent, or Firm* — Bucknam and Archer

(57) ABSTRACT

There is provided a vehicle lift which includes, under the support plate (1) of the vehicle a lifting/lowering mechanism (101) having at least two pairs of levers articulated to one another in an intermediate section, which constitute the two forks, moved by at least one fluid-dynamic actuator (9). The fluid-dynamic actuator (9) acts on an articulated system (10), which supports at least one first roller (20) and at least one second roller (21) arranged on respective axes. The two rollers (20, 21), in the initial step of lifting/opening the fork, are kinematically coupled with two corresponding inclined surfaces.

7 Claims, 4 Drawing Sheets

(56) References Cited

FOREIGN PATENT DOCUMENTS

| | | | |
|---|---|---|---|
| EP | 0937677 | A2 | 8/1999 |
| JP | 2005059978 | A4 | 3/2005 |

* cited by examiner

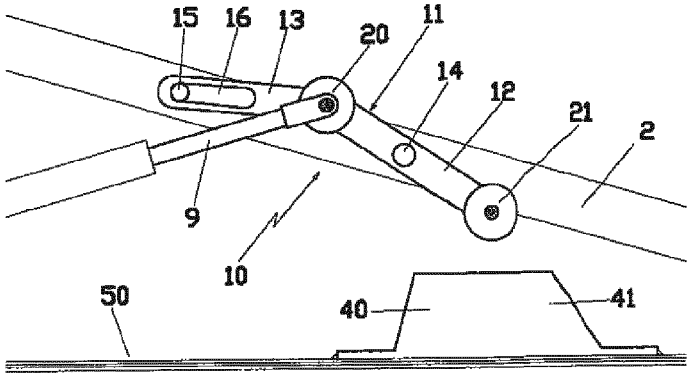
FIG.9
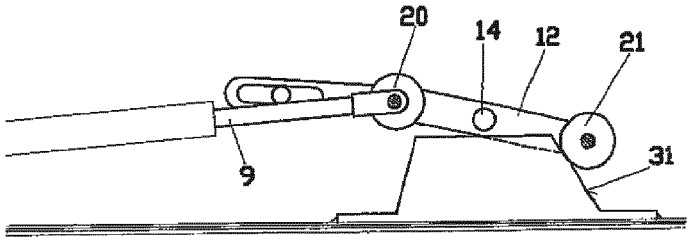
FIG.8
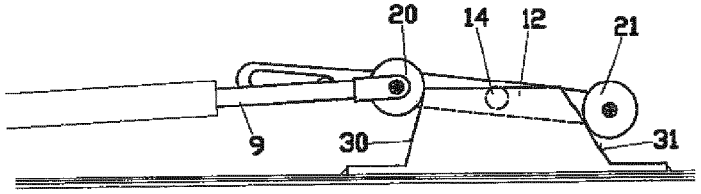
FIG.7
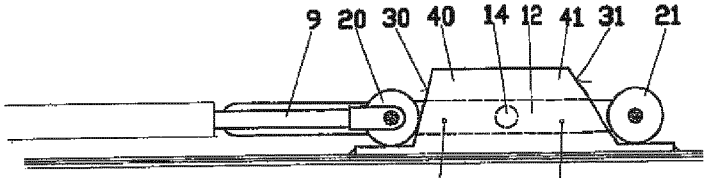
FIG.6
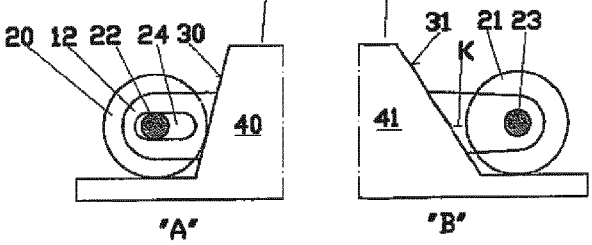

VEHICLE LIFT

CROSS REFERENCE TO RELATED APPLICATIONS

This application is the National Stage of PCT/EP2015/061154 filed on May 20, 2015, which claims priority under 35 U.S.C. § 119 of Italian Application No. VI2014A000135 filed on May 22, 2014, the disclosures of which are incorporated herein by reference. The international application under PCT article 21(2) was published in English.

The present finding concerns a vehicle lift, according to the general part of claim 1. As well known, among the various types of lifts, used in body shops and in garages to allow the worker to work on the lower part of a vehicle, so-called fork or similar type systems are commonly used.

Such a lifting group comprises, at the two sides of the support plane of the vehicle, a fork-type lifting/lowering mechanism, consisting of two pairs of levers articulated to one another at an intermediate section thereof and where the lever of each of the two pairs, the one arranged most externally, has the lower end hinged on the base plate, resting on the ground and the upper end sliding beneath the support plane for supporting the vehicle, with longitudinal direction, while, contrarily, the other two levers, those arranged most externally, have the lower end sliding on the aforementioned base plate and the upper end sliding beneath the aforementioned upper support plane for lifting the vehicle.

The two pairs of levers that constitute the two forks are moved by at least one fluid-dynamic actuator, having one end articulated on the cross member that connects the two lower ends of the two outermost levers and the other end articulated, through an intermediate bracket, to the two upper arms of the two innermost levers.

Usually, these lifts, due to the particular structure of the frame (fork plus support plane) and of the lifting mechanisms used, when they are completely closed, have a bulk in height that is acceptable for the majority of vehicles whereas, on the other hand, due to such bulk, they cannot be used for all cars, in particular sports and racing cars, in which the space between the bottom of the vehicle and the ground is very small.

In so-called "low profile" lifts, i.e. in lifts that have a limited bulk in height when they are completely "packed up", the difficulties mainly occur in the first lifting step, when the fluid-dynamic actuator has to develop the force (initial pickup) necessary to lift the load.

The value of such a force, as the lifting proceeds, decreases thanks to the increasing inclination of the cylinders so that, in practice, a great force (thrust) of the cylinders is only necessary in the first section of the upward stroke of the lift. In fact, substantial bulks in height and/or in width are in any case necessary in order to be able to install cylinders with sufficient dimensions in order to obtain the force necessary for lifting in the first part of the upward stroke, obviously using up material and energy.

Another limitation concerning fork-type lifts or similar consists of the fact that the structure must be limited in terms of the extension in width, in order to be able to be contained within the inner width of the wheels of the vehicle; moreover, the thrust mechanisms must not project from the upper plane since, frequently, sports and racing cars are lifted with the bottom, that rests directly on the plane of the lift.

The purpose of the present finding is to make a fork-type lift of the type described above, which does not have the drawbacks displayed by similar known products.

Specifically, the purpose of the finding is to make a fork-type lift that, as well as having a minimum bulk in height that is smaller than that of lifts found on the market, also associated the properties of requiring, at the start of lifting, a thrust force of the jacks of substantially lower value than the thrust force required by common lifts.

A further purpose is to make a fork-type lift or similar, which has a simplified and light structure, with the elements that constitute the lifting mechanism, in particular the levers, the pins and the components of the oil-hydraulic circuit, of reduced dimensions; at the same time it must be suitably strong, so that the mechanical safety system, applied to the structure, allows workers to work beneath the lifted vehicle in optimal conditions.

Such purposes are achieved by inserting, between the fluid-dynamic actuator and the lifting mechanism consisting of the fork levers, an articulated system consisting of two connecting rods and a rocker arm, where the two mutually opposite side walls of the rocker arm, hinged between the two innermost levers, support at least one first roller, hinged with rotary coupling on a first pin, which joins the upper end of the fluid-dynamic actuator with the rocker arm, said first roller working in kinematic coupling with a first surface that is variable from a horizontal position to an inclined position with respect to the ground and at least one second roller, hinged with rotary coupling on a second pin, positioned on the opposite side on said rocker arm. Such a second roller works in kinematic coupling with a second surface, variable from a horizontal position to an inclined position with respect to the ground.

Operatively, when the lift is completely closed and packed, the fluid-dynamic actuator and the articulated system are aligned with each other on the same horizontal axis so that, being able to use oil-hydraulic cylinders of reduced dimensions, it is possible to reduce to the minimum the bulk in height of the lift, i.e. the distance between the base plate, resting on the floor, and the upper lifting plane, where the vehicle rests.

Thereafter, through the effect of the kinematic coupling described above, the fork mechanism moves, carrying out a greater vertical stroke than the trajectory travelled by the rollers on the respective inclined surfaces, with the practical result of requiring a lower thrust force, the so-called "pickup", of the fluid-dynamic actuator, in the first lifting step, such as to be almost equal to the value of the force required by the aforementioned actuator when the lift is almost completely lifted.

Further advantages and characteristics of the finding will become clearer from the description of a possible embodiment thereof, given only as a non-limiting example, with the help of the attached tables of drawings, where:

FIG. 2 is a plan view sectioned according to the line II-II of FIG. 4, whereas FIGS. 3 and 4 are elevated views, respectively sectioned according to the lines III-III and IV-IV of FIG. 2;

FIGS. 6 and 7 represent the operation of the articulated rocker arm/pair of connecting rods group and the position of the rollers with respect to the respective surfaces, during the initial lifting steps;

FIGS. 8 and 9 represent the operation of the articulated rocker arm/pair of connecting rods group and the position of the rollers with respect to the respective surfaces, during the steps after the initial lifting ones.

Figure 1:
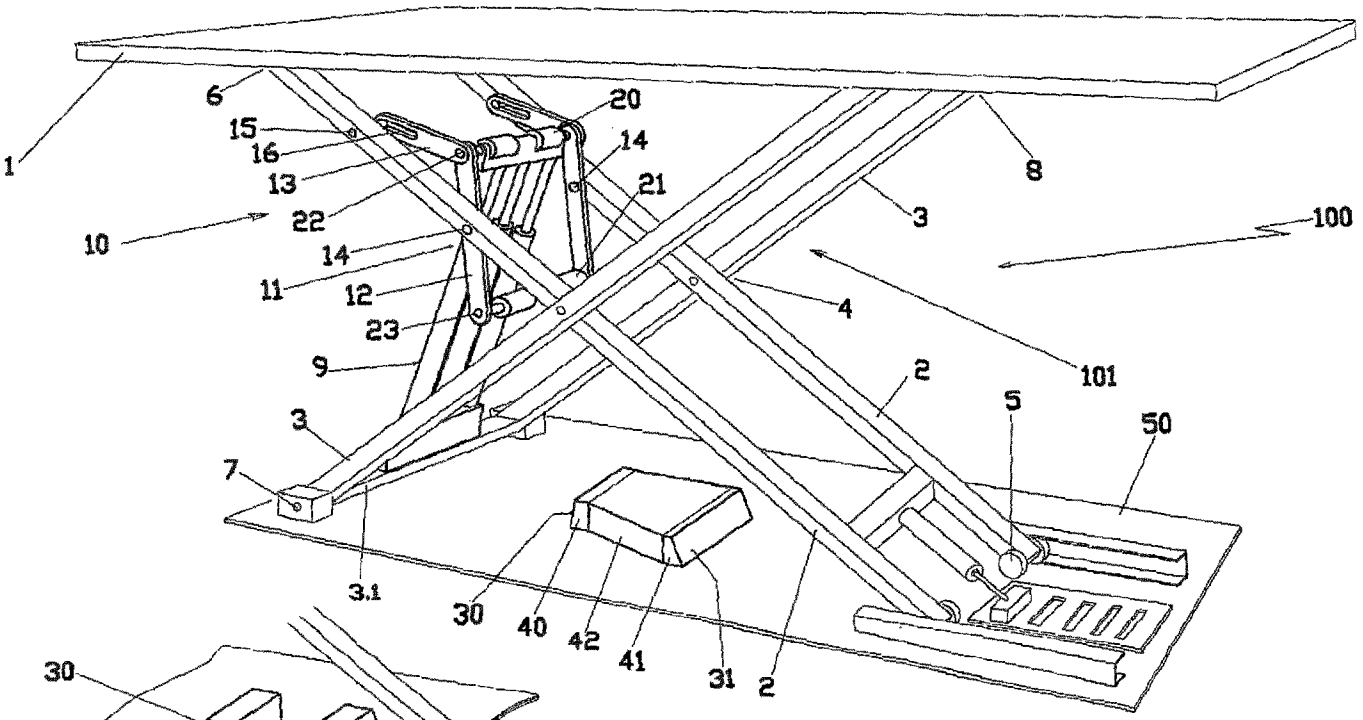
FIG. 1 represents a perspective view of the lift according to the finding, in open condition.
Figure 10:
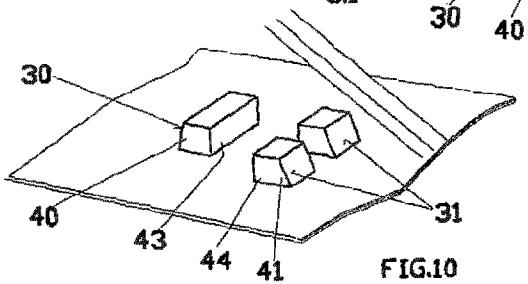
FIG. 10 represents a detailed view of a variant of FIG. 1.
Figures 2, 3, 4:
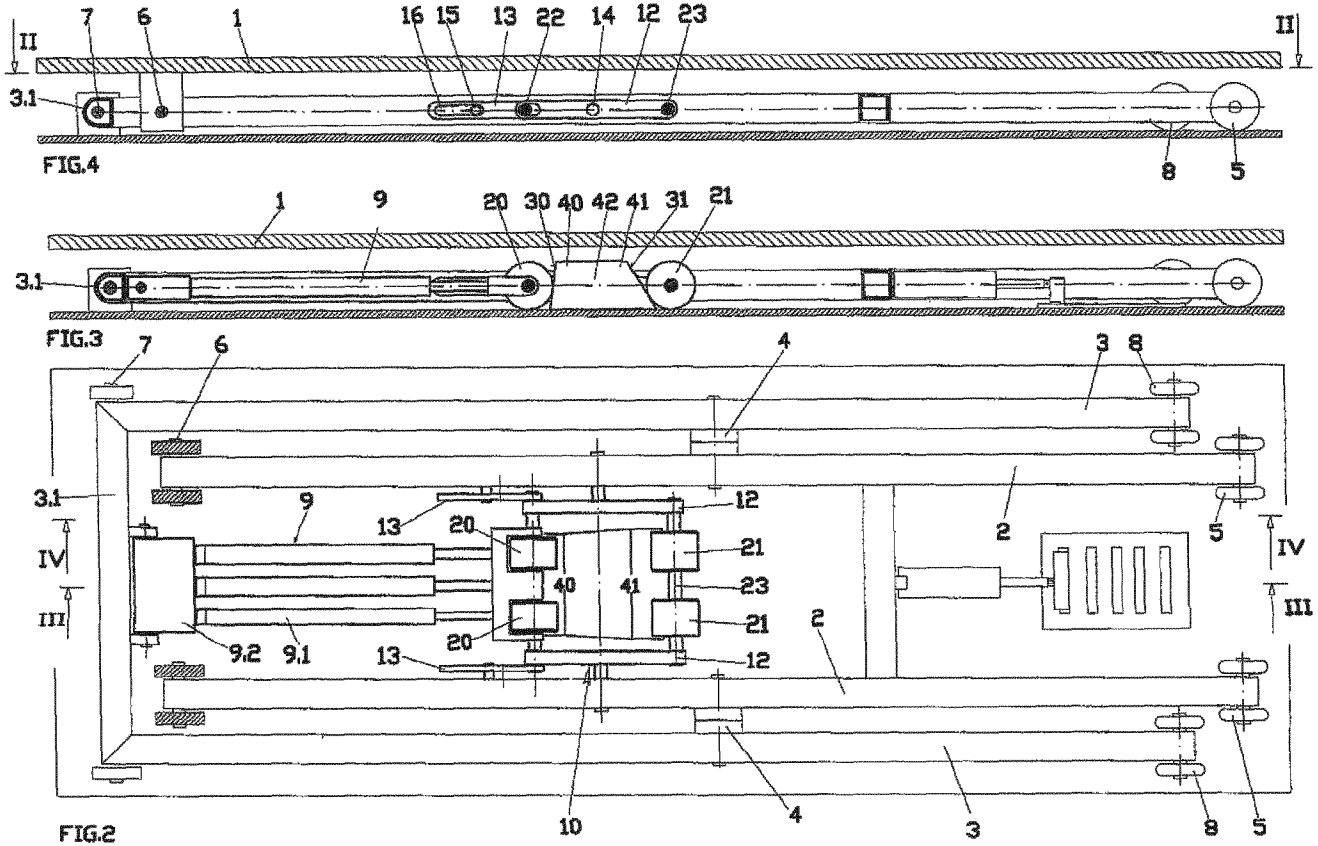
FIGS. 2, 3 and 4 represent section views of the lift according to FIG. 1, in completely closed condition.

In FIGS. 1-3 it is possible to see a vehicle lift according to the finding, indicated with reference numeral 100, where the lifting/lowering movement of the upper support plane 1 is obtained by a moving group 101, which comprises, at each of the two longitudinal sides of said support plane 1, two pairs of levers 2 and 3, articulated to each other at an intermediate section 4; the two parallel levers 2, arranged most internally, are equipped at the lower end with wheels 5 able to slide at the ground level, along a trajectory concordant with the longitudinal axis of the plane 1 and the upper end hinged with a first pin 6 below the plane 1, whereas the two levers 3, arranged most externally, have the lower end hinged with the second pin 7 to the base 50, resting on the ground and the upper end equipped with wheels 8, able to slide below the plane 1.

The entire lifting mechanism is actuated by a fluid-dynamic actuator, wholly indicated with reference numeral 9, which has the lower end articulated on a cross member 3.1, which connects the two outermost levers 3, whereas the upper end acts on an articulated system, wholly indicated with reference numeral 10, to give a synchronous movement to the two lateral scissors.

The articulated system 10, which connects to the two innermost levers 2, consists of a rocker arm, wholly indicated with reference numeral 11 and two connecting rods 13, where each of the two side walls 12 of the rocker arm 11 is hinged on a corresponding intermediate axis 14, whereas the connecting rods 13 are held by two projecting pins 15, on which the corresponding slits 16 slide, which are formed on said corresponding connecting rods 13.

Moreover, the rocker arm 11 supports, at the two opposite ends, at least two rollers 20 and 21, which, in the first lifting step (opening of the fork) of the lift, move in kinematic contact with at least two corresponding inclined surfaces 30 and 31, formed on two opposite portions 40 and 41 of a single block 42, or made on two opposite portions 40 and 41 of two or more separate blocks 43 and 44.

In particular, as can be seen in FIG. 3, the portions of the two surfaces 30 and 31, which are in kinematic contact with the corresponding rollers 20 and 21, are inclined a mutually convergent manner (in the illustrated example, upwards) and have the same or different inclination to each other and a shape suitable for optimising the thrust of the fluid-dynamic actuator 9.

Figure 5:
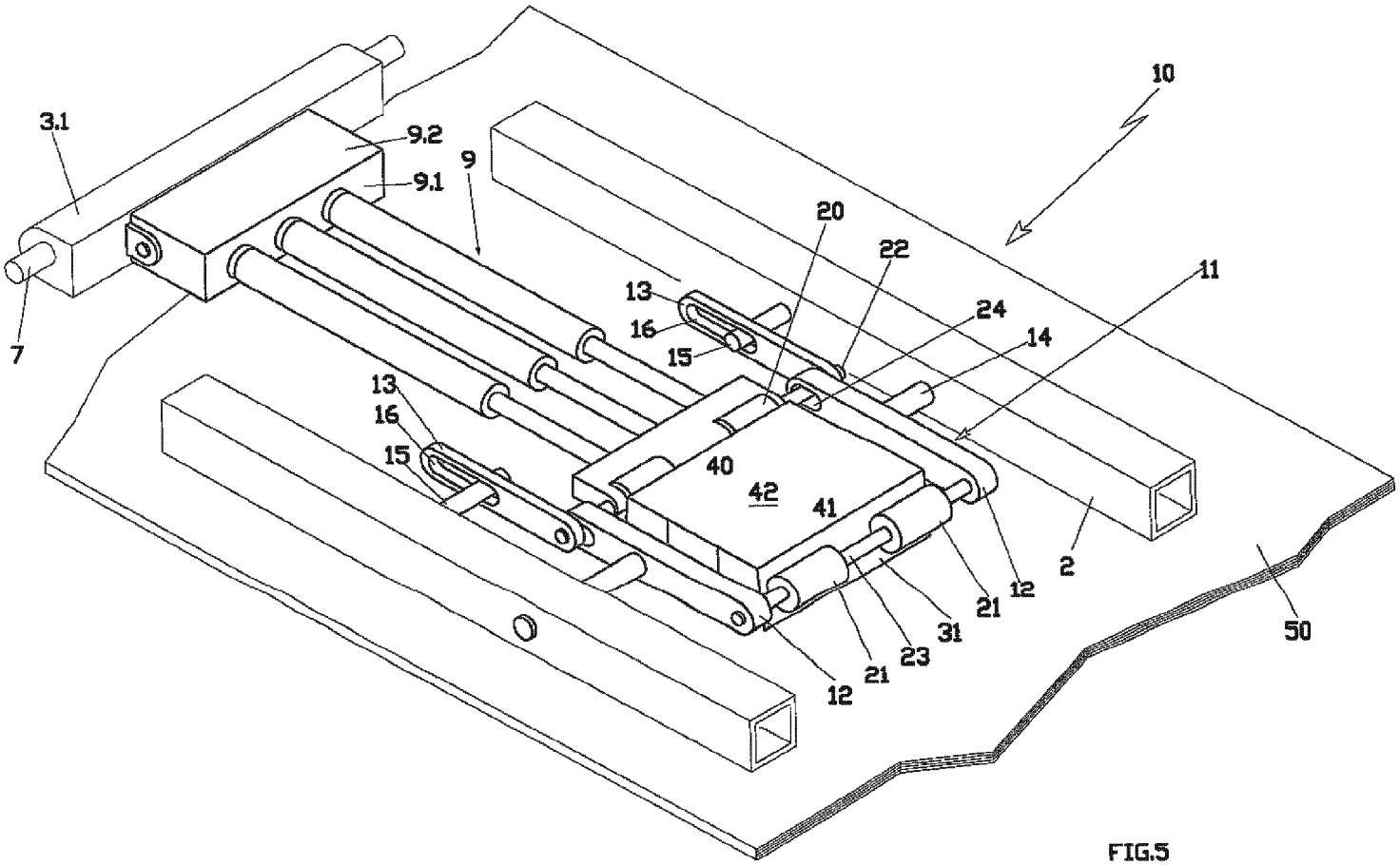
FIG. 5 represents a perspective view of the articulated system, in completely closed condition of the lift, with the position of the rollers on the respective inclined surfaces.

Constructively, as can be seen in particular in FIG. 5, the opposite rollers 20 and 21 are hinged on the pins 22 and 23 and the front pin 22 has a dual function: that of articulating the rocker arm 11/connecting rod 13 pair and that of fastening the upper part of the fluid-dynamic actuator 9, which transmits the force to the articulated system 10.

Operatively, as can be seen in the sequence of FIG. 6 and thereafter, with the constructive solution according to the finding, in the initial lifting step, it is foreseen for the two opposite rollers 20 and 21, supported by the rocker arm 11, which angularly rotates on the intermediate axis 14 when, through the effect of the thrust of the fluid-dynamic actuator 9, said rocker arm gradually lifts in combination with the opening of the fork, which move, in the first fraction of stroke, both in contact with the respective inclined surfaces 30 and 31 (FIG. 7); thereafter, only the second roller 21 (FIG. 8) remains in contact and, thereafter again, the roller 21 also completely moves away from the corresponding surface 31 (FIG. 9) and the lift continues the upward stroke.

In practice, laboratory tests and practical garage tests have confirmed that, through the effect of the balancing of the opposing forces that act at the contact point of the rollers 20 and 21 on the corresponding blocks 42 or 43 and 44, the thrust force, or "pickup", required of the actuator 9 in the initial upward step is substantially less than the initial thrust force required of the actuator mounted on normal lifts.

In a second embodiment, as can be seen in the details "A-B" of FIG. 6, when the lift is totally closed (horizontal axis) the roller 21 is slightly distanced (K) from the corresponding surface 31 so that, in the initial lifting step, only the front roller 20 rests on the relative surface 30 and, only thereafter, the aforementioned second roller 21 also goes back to rest; thereafter, in the upward step, the roller 21 also moves away from the respective surface 31.

The finding also foresees, as can be seen in FIG. 5 and in the detail of FIG. 6, that the front pin 22, hinged to the two side walls 12 of the rocker arm 11, is engaged inside two grooves 24, which allows the aforementioned pin 22, in the initial operating step, to travel a short stroke inside the grooves 24, during the contact of the roller 20 with the inclined surface 30.

Constructively, the fluid-dynamic actuator 9 is made up of a plurality of jacks 9.1, screwed to a single supply block 9.2, which acts as hinging means of the entire group 9 to the cross member 3.1.

In practice, a further embodiment operating according to the ways described above, foresees that the two inclined surfaces 30 and 31 are applied below the plane 1.

Similarly, another embodiment, again operating according to the ways described above foresees that the two inclined surfaces 30 and 31 are applied on the levers 2 and 3 of the fork mechanism.

Again in practice, the articulated system 10 and the inclined surfaces 30 and 31, can be applied, as well as to vehicle lifts with single and double fork, also to lifts with lifting/lowering mechanism consisting of at least two pairs of articulated levers, for any use and with a support device consisting of a single platform, two platforms, multiple platforms or with different forms of load supports.

Moreover, the rollers 20 and 21 can be replaced with sliding blocks which move in contact with the corresponding shaped surfaces 30 and 31.

The present finding can undergo modifications and variants and its technical details can be replaced with other technically equivalent elements; moreover, the materials and sizes can be various, according to requirements, provided that it is encompassed by the inventive concept defined by the following claims.

The invention claimed is:

1. A vehicle lift including a vehicle support plane (1), a base plate (50), and a lifting/lowering mechanism (101) disposed between said vehicle support plane and said base plate, said lifting/lowering mechanism comprising:

two pair of levers (2,3) each arranged laterally supporting said vehicle support plane, the levers (2,3) of each pair being articulated to one another scissor like in an intermediate section (4) defining parallel inner levers (2,2) and parallel outer levers (3,3), the inner levers of each pair each having a first end hingedly connected said vehicle support plane and each having a second end adapted to slide longitudinally on said base plate, the outer levers of each pair each having a first end adapted to slide longitudinally on an underside of said vehicle support plane and each having a second end hingedly connected to said base plate;

an articulated system (10) interconnecting the inner levers of the two pair of levers and including a rocker arm (11) comprising two lateral side wall elements (12) each hingedly connected at an intermediate axis (14) to a respective inner lever of said tow pair of levers, a first roller (20) rotatably supported on an axle pin (22) interconnecting said lateral side wall elements at a first end of said rocker arm, a second roller (21) rotatably supported on an axle pin (23) interconnecting said lateral side wall elements at a second end of said rocker arm, in a collapsed condition of said vehicle lift said first roller (20) engaging for rotation thereon a first inclined plane (30) and said second roller (21) engaging for rotation thereon a second inclined plane (31), said first and second inclined planes being upwardly converging; and a fluid-dynamic actuator (9) articulated at a first end to a member interconnecting the second ends of the outer levers of the two pair of levers and operatively connected at a second end to said axle pin at the first end of said rocker arm of said articulated system, whereby upon commencement of lifting and opening the vehicle lift, the fluid-dynamic actuator (9) acts on the articulated system (10) imparting a thrust to the axle pin at the first end of the rocker arm (11) causing the first roller (20) to move upwardly on the respective inclined plane (30) and as a result of the rocker action of the rocker arm (11) an upward movement is imparted to the intermediate axis (14) connecting the rocker arm (11) to the inner levers of the two pair of levers (2,3) resulting in upward movement of the inner levers and commencement of lifting and opening of the vehicle lift and simultaneously the second roller (21) is moved upwardly on the second inclined plane (31).

2. The vehicle lift as defined in claim 1, wherein said articulated system further includes a pair of connecting rods (13) extending from the first end of said rocker arm (11), each connecting rod articulated at a first end to a respective side wall element at the axle pin of the first end of the rocker arm, a second end of each connecting rod having an elongated slot (16) engaged with a pin (15) extending from a respective connected lever of the inner levers of the two pair of levers (2,3).

3. The vehicle lift as defined in claim 1, wherein said axle pin (22) supporting said first roller (20) at the first end of said rocker arm is rotatably supported in a longitudinal slot (16) formed in each lateral side wall element (12) of said rocker arm, whereby upon commencement of lifting and opening the vehicle lift, said axle pin (22) at the first end of said rocker arm travels a short stroke within the longitudinal slots in the lateral said wall elements of said rocker arm during contact of said first roller (20) with said first inclined plane (30).

4. The vehicle lift as defined in claim 1, wherein said first and second inclined planes have convergent identical inclinations.

5. The vehicle lift as defined in claim 1, wherein said first and second inclined planes have convergent different inclinations.

6. The vehicle lift as defined in claim 1, wherein said upwardly converging first and second inclined planes are formed on opposing surfaces of a single block (42).

7. The vehicle lift as defined in claim 1, wherein said upwardly converging first and second inclined planes are formed on opposing surfaces of two separate and oppositely positioned blocks (43,44).

* * * * *